United States Patent [19]

Liu et al.

[11] 4,199,401

[45] Apr. 22, 1980

[54] FELT FOR PAPERMAKING MACHINE

[75] Inventors: Thomas J. Liu, Chapin, S.C.; Cyrille M. Cottigny, deceased, late of Clinton, S.C., by Gisele B. Cottigny, executrix

[73] Assignee: Asten Group, Inc., Devon, Pa.

[21] Appl. No.: 16,504

[22] Filed: Mar. 1, 1979

[51] Int. Cl.[2] ..... B32B 5/12

[52] U.S. Cl. ..... 162/358; 428/282; 428/298; 428/303

[58] Field of Search ..... 162/358, 289; 428/282, 428/298, 299, 300, 301, 303

[56] References Cited

U.S. PATENT DOCUMENTS

| | | | |
|---|---|---|---|
| 3,206,351 | 9/1965 | Smith | 428/300 X |
| 3,664,905 | 5/1972 | Schuster | 428/282 X |
| 3,928,699 | 12/1975 | Fekete | 162/358 X |
| 4,162,190 | 7/1979 | Ashworth | 162/358 X |

*Primary Examiner*—Richard V. Fisher

*Attorney, Agent, or Firm*—Watson, Cole, Grindle & Watson

[57] ABSTRACT

A felt for use in a papermaking machine includes a surface layer of coarse fibers and an underlayer of relatively fine fibers secured to the surface layer. The surface layer supports a wet paper web as the felt and the web are moved through the press section of the machine. At the exit side of the nip of the press rolls, the water within the felt migrates by capillary action away from the web side to the finer underlayer as the nip pressure at the press section is released. Web rewetting is therefore significantly decreased.

1 Claim, 2 Drawing Figures

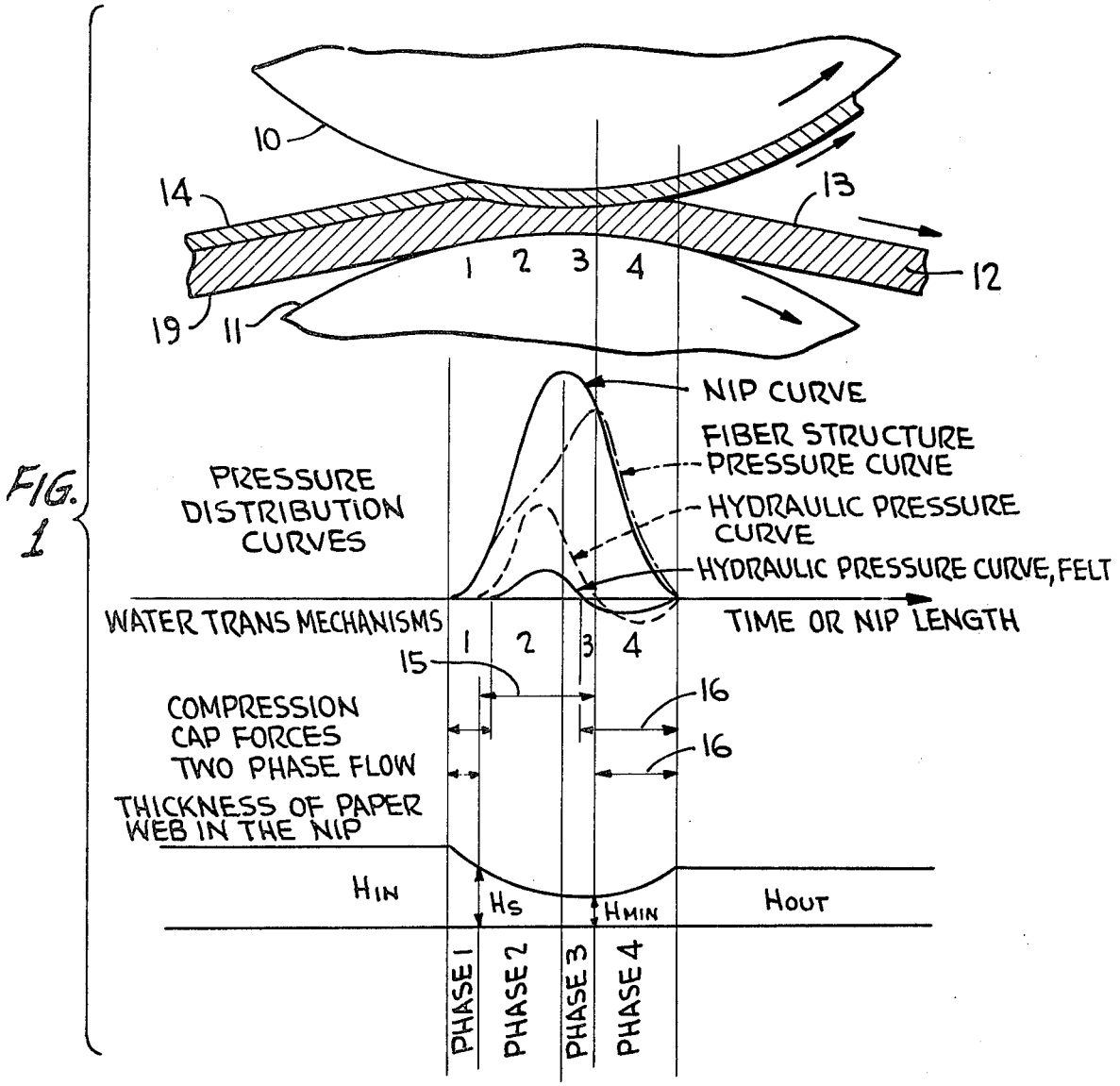
FIG. 1
FIG. 2
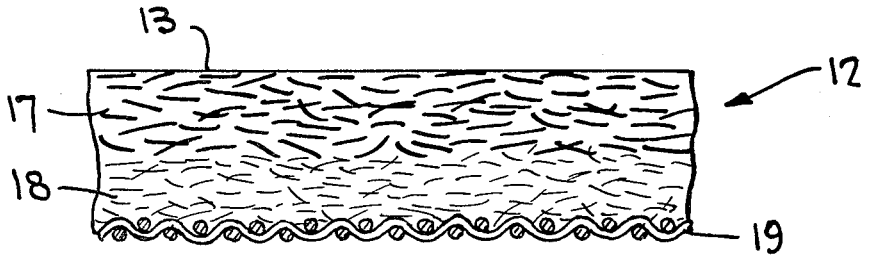

FELT FOR PAPERMAKING MACHINE

BACKGROUND OF THE INVENTION

This invention relates generally to a felt for use in a papermaking machine, and more particularly to such a felt constructed as having a surface layer of coarse fibers and an underlayer of relatively fine fibers for minimizing paper sheet rewetting as the water within the felt migrates away from the sheet side to the finer underlayer.

Rewetting is a phenomenon in which water pressed from the sheet at mid-nip re-enters the sheet on the exit side of the nip. The theory of rewetting has been discussed by P. B. Wahlstrom, Pulp and Paper Magazine Canada, 70, No. 19: 76 (1969). Wahlstrom pointed out that capillary transfer in the felt/sheet interface appears to be the controlling mechanism in rewetting. He also emphasized the importance of felt design in minimizing rewetting.

In the current decade, designers of needled felts have sought to minimize rewetting by stratification of batt using a fine surface layer on the sheet side to create the desired capillary forces. Such a felt design is disclosed in U.S. Pat. No. 3,928,699. It has been found, however, that inverse batt stratification, i.e., a surface layer of coarse fibers and an underlayer of finer fibers, more effectively minimizes sheet rewetting.

It is generally known that capillary attraction or repulsion forces are the resultant of adhesion, cohesion and surface tension in liquids which are in contact with solids as in a capillary tube. When the cohesive force is greater the surface of the liquids tends to rise in the tube, and when the adhesion force is greater the surface tends to be depressed in the tube. This can be directly related to the denier (coarseness) of the fibers used in batt material on wet felt. Accordingly, this would mean that the finer the fibers, the more efficient the water absorbtion and vice versa.

SUMMARY OF THE INVENTION

It is an object of the present invention to minimize sheet rewetting at the press section of a papermaking machine, by the provision of a support felt which effects migration of the water in the felt away from the sheet side to the felt underlayer.

Such a felt, according to the invention, has a surface layer of coarse fibers and an underlayer of relatively fine fibers. The water in the felt therefore migrates away from the sheet side to the finer underlayer as caused by capillary action as the nip pressure at the press section is released.

Another object of this invention is to provide such a felt wherein the coarse and fine fibers have, in terms of fiber measurement, a difference of at least 5.0 denier.

Other objects, advantages and novel features of the invention will become more apparent from the following detailed description of the invention when taken in conjunction with the accompanying drawings.

BRIEF DESCRIPTION OF THE DRAWINGS

FIG. 1 is a partial sectional view taken through a typical flow press nip, the press operation at the nip being illustrated by different phases based mainly on the principle mechanisms involved in water transfer; and FIG. 2 is a sectional view taken through the felt made in accordance with the invention.

DETAILED DESCRIPTION OF THE INVENTION

Turning now to the drawings wherein like reference characters refer to like and corresponding parts throughout the several views, a pair of spaced apart rolls 10 and 11 are partially shown in FIG. 1 as typically provided at the press section of a papermaking machine. A felt generally designated 12 has an outer surface 13 which supports a wet paper web 14 in contact therewith. The felt and paper web pass through (from left-to-right in FIG. 1) the nip of rolls 10 and 11, and the paper web follows the course of roll 10 at the exit side of the nip as in any typical operation of this type.

As described in the aforementioned Wahlstrom paper, the transversal flow press nip normally comprises two rolls, one of which being rubber covered and which are pressed together. Through the nip defined by the rolls, a web of paper is pressed so that water flows in a plane perpendicular to paper and felt giving the shortest possible distance for the water to flow. Water is squeezed from the paper web into the felt in the compressional phase, and some of this water is reabsorbed by the paper from the felt in the expansion phase.

In FIG. 1, both felt 13 (shown in more detail in FIG. 2) and paper web 14 are unsaturated entering the nip defined by the solid rolls 10 and 11. Both contain a sufficient amount of water to reach saturation before mid-nip. The geometric configuration, the pressure distribution curves, the water transfer mechanisms and the thickness curves for paper and felt are shown for the nip. The nip has been divided into four phases.

Phase 1 starts at the entrance of the nip where the pressure curve begins and until the paper has become saturated. The felt is shown unsaturated in phase 1, and no hydraulic pressure develops in this phase. Phase 2 extends from the point of saturation to mid-nip, or more accurately to the maximum point of the total nip pressure curve. In this phase the felt also reaches saturation.

Phase 3 extends from the maximum point of the nip curve to the point of maximum paper dryness. This maximum dryness point corresponds to the maximum in the paper structure pressure curve, and zero hydraulic pressure in the paper. In this expanding part of the nip, the felt passes zero hydraulic pressure and becomes unsaturated.

Phase 4 covers the point where the paper starts to expand and becomes unsaturated creating a two-phase system of water and air. The felt is unsaturated through this entire phase and expands continuously.

In addition to the pressure curve, arrows have been marked in FIG. 1 to show the type of mechanisms acting in different parts of the nip. This includes flow of water through compression, from the end of phase 1 to the end of phase 3. This area, marked 15, involves the aforementioned U.S. Pat. No. 3,928,699 directed to a particular batt stratification wherein the underlayer of coarse fibers will provide a semi-rigid latice-like structure when the fabric is subject to compression. Also, the smooth surface layer is described as more effectively passing water from the associated web of paper in this compression zone. Other areas marked in FIG. 1 include a two-phase flow through capillary forces and a two-phase flow through compression and expansion. The present invention pertains to only these areas marked 16.

In phase 2, water is flowing out of the system through compression. Before the felt is saturated, there are capillary forces promoting water transfer from paper to felt in the beginning of phase 2.

Since phase 3 is an expanding portion of the nip and the paper in this phase still gets further compressed, the felt must take up all of the expansion. Due to some lateral flow of water through the nip, the felt is saturated through a small part of phase 3 corresponding approximately to the felt thickness, but soon becomes unsaturated. This creates a vacuum in the felt forcing air and water to enter the felt from underneath through the fabric or grooves. A fluid flow of water is therefore still active in phase 3 as a transfer mechanism from paper to felt. Air and water enters the felt in a two-phase flow system. Capillary forces help transfer water from paper to felt.

In phase 4 both paper and felt expand and the paper also becomes unsaturated. A negative pressure is created in both structures. The compressive forces on the fiber structure and the felt are larger than the total pressure. Capillary forces will act within and between the paper and felt in this two-phase system. When felt and paper are separated at the end of phase 4, water existing in the interface between felt and paper will be divided due to film splitting. And, in phase 4, the paper enters at maximum dryness and absorbs water from the felt. In this phase, only a two-phase air-water system exists. The transfer mechanism can only be through capillary forces existing in the interface between the paper and the felt and through two-phase flow due to a gross pressure difference between paper and felt due to expansion. This analysis of nip conditions confirms the basic mechanisms as being compression of paper in the ingoing part of the nip resisted by the pressure in the structure and the fluid flow through paper and the felt; and as rewetting in the expanding, unsaturated area in the outgoing part of the nip transferring water from felt to paper.

As further mentioned by Wahlstrom in his paper, the function of the felt at the nip is to provide a structure to which water from the paper can flow in the ingoing part of the nip and which will retain most of this water in the expanding part of the nip. In accordance with the invention, it has been found that a felt having the type of batt strata as herein described minimizes web rewetting in the outgoing part of the nip.

Referring to FIG. 2 felt 12 according to the invention comprises a fibrous surface layer 17 which includes outer surface 13 and is comprised of a batt of coarse fibers having predetermined denier measurements. A fibrous underlayer 18 is secured to layer 17 and comprises a batt of relatively fine fibers having a predetermined denier measurement less than the denier measurement of the surface layer of fibers. Also, the felt includes a reinforcing base fabric 19 which may be a woven or non-woven structure, similar to the base fabric disclosed in the aforementioned '699 patent.

Table 1 below shows the various comparative tests of felt samples having a batt stratification according to the art as well as inverse batt stratification according to the invention, after the tops of the felt were subject to a pressure of 1378 KPa. For example, felt samples 3, 4, 6 and 7 are in accordance with the invention (coarse surface layer—fine underlayer), while the remaining felt samples are of a type known in the prior art (fine surface layer—coarse underlayer). Also, it should be pointed out that felt sample No. 5 has it surface layer comprises of a mixture of 6 and 10 denier fibers.

TABLE 1

COMPARATIVE TEST RESULTS

| Felt Samples | Conditioned weight of felt samples in grams | Wet weight in grams of wrung felt samples | Moisture content in % in felt samples | Conditioned weight in grams of paper sample | Weight in grams of wet paper samples after going through the press on top of felt at 1378KPa | Moisture pick-up in paper samples given in grams | % Moisture (by weight) in sheet |
|---|---|---|---|---|---|---|---|
| No. 1 top 6 d. bot. 20 d. | 50.0 | 80.0 | 60.0 | 1.24 | 2.65 | 1.41 | 113.7 |
| No. 2 top 3 d. bot. 15 d. | 55.0 | 88.5 | 60.9 | 1.20 | 2.83 | 1.63 | 135.8 |
| No. 3 top 20 d. bot. 3. | 50.5 | 83.5 | 65.3 | 1.20 | 1.57 | 0.37 | 30.8 |
| No. 4 top 15 d. bot. 3 d. | 55.2 | 90.0 | 63.0 | 1.28 | 1.68 | 0.40 | 31.2 |
| No. 5 top 6 + 10 d. bot. 40 d. | 57.5 | 95.0 | 65.2 | 1.25 | 3.04 | 1.79 | 143.2 |
| No. 6 top 15 d. bot. 6 d. | 56.0 | 90.5 | 61.6 | 1.29 | 1.84 | 0.55 | 42.6 |
| No. 7 top 15 d. bot. 10 d. | 61.2 | 101.2 | 65.3 | 1.29 | 2.53 | 1.24 | 96.1 |

It can be seen from this Table that the best results achieved in minimizing a rewetting of the paper sheet was achieved with felt samples Nos. 3, 4 and 6 wherein the percentage of moisture (by weight) left in the sheet after exiting the nip is the smallest. A difference in denier measurements of the fibers between the surface layer 17 and underlayer 18 is 17 and 12, respectively for sample Nos. 3 and 4 which achieved the best results. The denier difference is 9 for sample No. 6 showing the next best results, and the denier difference is 5 for No. 7 showing a moisture content by weight left in the sheet as less than 100%.

It has been likewise found that outer surface 13 of the felt is able to be maintained dryer as compared to a felt outer surface having a batt stratification according to the prior art. This is a further factor in reducing rewetting due to the increased capillary suction in the felt at a low degree of saturation and high compression and the lower availability of the water. The felt should be sufficiently dried as not to be saturated in mid-nip. And, as pointed out by Wahlstrom, there are indications that the rewetting occurs only at the first part of the standing phase and is limited by the availability of water in the interface. Thus, by operating with the dry felt web rewetting can be minimized.

As further pointed out by Wahlstrom, "Rewetting has been established as a general mechanism under all press conditions and is shown to be speed independent and of sufficient magnitude to effect significantly the moisture content of the sheet. Capillary transfer in the interface seems to be the controlling mechanism." The felt according to the invention, with its surface layer of coarse fibers and its underlayer of fine fibers, has been shown by experimentation that the finer the fibers, the more they are apt to attract moisture by capillary action. Also, the finer the batt fibers the dryer the felt can be pressed. When fine batt is brought into contact with coarser batt, the water from the coarse batt migrates back into the fine layer by capillary action.

Obviously, many modifications and variations of the invention are made possible in the light of the above teachings. Therefore it is to be understood that within the scope of the appended claims, the invention may be practiced otherwise than as specifically described.

It is claimed:

1. A felt for use in a papermaking machine, said felt having an outer surface for supporting a wet paper web in contact therewith, said felt and said web passing through the nip of pressure rolls of the machine, the felt being characterized for minimizing a rewetting of the web after passing through said nip and consisting essentially of, a fibrous surface layer including said outer surface, and a fibrous underlayer secured to said surface layer, said underlayer including a reinforcing base fabric, said surface layer comprising a batt of fibers having a predetermined denier measurement, said underlayer comprising a batt of fibers having a predetermined denier measurement less than the denier measurement of said surface layer fibers, the difference between the denier measurement of said surface layer fibers and the denier measurement of said underlayer fibers being at least 5.00 denier, whereby water within said felt after passing through said nip migrates away from said outer surface to said fibrous underlayer as caused by capillary action as pressure on said felt and said web is released.

* * * * *